US005094495A

United States Patent [19]

Littell

[11] Patent Number: 5,094,495

[45] Date of Patent: Mar. 10, 1992

[54] MECHANISM FOR LIFTING AND ORIENTING AN OBJECT

[76] Inventor: Edmund R. Littell, 81 High St., Winnetka, Ill. 60093

[21] Appl. No.: 574,756

[22] Filed: Aug. 30, 1990

Related U.S. Application Data

[63] Continuation of Ser. No. 463,284, Jan. 10, 1990, abandoned, which is a continuation of Ser. No. 143,976, Jan. 14, 1988, abandoned.

[51] Int. Cl.[5] ..... B66C 1/02

[52] U.S. Cl. ..... 294/65; 294/86.41; 414/917

[58] Field of Search ..... 294/65, 64.1, 67.2, 294/67.21, 67.31, 67.5, 81.51, 86.41; 414/728, 730, 917; 901/14, 22

[56] References Cited

U.S. PATENT DOCUMENTS

| | | | |
|---|---|---|---|
| 1,792,576 | 2/1931 | Dryon . | |
| 2,514,307 | 7/1950 | Boyd | 294/82 |
| 3,341,243 | 9/1967 | Archer et al. | 294/67 |
| 3,598,263 | 8/1971 | Ehmke | 214/652 |
| 3,648,856 | 5/1969 | Gaarder | 254/93 |
| 4,411,587 | 10/1983 | Niki | 414/917 X |
| 4,451,196 | 5/1984 | Harada et al. | 414/733 |
| 4,634,338 | 1/1987 | Tsuge et al. | 414/917 X |
| 4,666,364 | 5/1987 | Doege et al. | 414/917 X |
| 4,801,235 | 1/1989 | Rauschdorf | 414/917 X |

FOREIGN PATENT DOCUMENTS

| | | | |
|---|---|---|---|
| 11559 | 1/1977 | Japan | 414/917 |
| 1253942 | 2/1986 | U.S.S.R. | 414/917 |
| 1253944 | 2/1986 | U.S.S.R. | 414/917 |

*Primary Examiner*—Margaret A. Focarino
*Assistant Examiner*—Dean J. Kramer
*Attorney, Agent, or Firm*—Allegretti & Witcoff, Ltd.

[57] ABSTRACT

The invention comprises an improved mechanism for lifting and orienting or tilting objects about a definable pivot axis of rotation. The device is comprised of a quadrilateral frame with each frame member pivotally connected to the adjacent frame members, and wherein one frame member is adapted to be externally supported and to allow the frame to be pivoted about a first generally horizontal axis of rotation, and the opposite side frame member is adapted to support an object, and including a handle for altering the angular relationship of the frame members to thereby pivot or tilt the object about the a second axis of rotation passing through the center of gravity of the object and parallel to the first axis of rotation, and further including mechanism to counterbalance the weight of the frame.

27 Claims, 3 Drawing Sheets

MECHANISM FOR LIFTING AND ORIENTING AN OBJECT

This is a continuation of application Ser. No. 463,284 filed Jan. 10, 1990, now abandoned, which was a continuation of application Ser. No. 143,976, filed Jan. 14, 1988, now abandoned.

BACKGROUND OF THE INVENTION

1. Field of the Invention

This invention is in the field of devices used to lift and precisely orient an article, particularly large, planar objects.

2. Description of the Prior Art

Heretofore various constructions have been used to lift, rotate, or upend large planar objects, such as plate glass windows. These prior art devices rotate objects around an axis outside the body of the object. Generally, in performing this rotation an object is rolled over an external structure. This requires considerable force and lacks precise control. These remains the need for a device that allows objects, such as plates of glass, to be lifted and oriented with a minimal amount of force and a maximum amount of control.

SUMMARY OF THE INVENTION

Briefly the present invention comprises an improved mechanism for lifting and orienting or tilting objects about a definable axis of rotation. The device is comprised of a quadrilateral frame with each frame member pivotally connected to the adjacent frame members, and wherein one frame member is adapted to be supported by external means said external means allowing the frame to be pivoted about a first generally horizontal axis of rotation, and the opposite side frame member is adapted to support an object, and further including means for altering the angular relationship of the frame members to thereby pivot or tilt the object about a second axis of rotation parallel to the first axis.

This device provides a means for lifting and orienting an object by rotating it about an axis. The preferred construction provides for arranging of the second axis coincident with the center of gravity of the object being carried and tilted. One advantage of lifting and orienting in such a manner is that it requires very little force compared to the rotation about an axis outside the object. Therefore, the device has the advantage of allowing manipulation of an object without the assistance of a large external power source. In addition the lessened force also supplies the advantage of much more control over the object than the prior art devices.

Accordingly it is an object of this invention to supply an improved simple and inexpensive means for lifting and orienting objects.

It is another object of this invention to supply means for lifting and orienting objects with a minimal amount of force.

It is an additional object of this invention to supply a means for lifting and orienting objects of varying size and composition.

Still another object of the present invention to provide an improved mechanism for lifting and orienting an object comprising a quadrilateral frame that utilizes an axis of rotation within the object to effect the lifting and orienting of the object.

Another object is to provide an inexpensive, simple and unique construction for lifting, moving and reorienting various shaped objects.

These and other objects, advantages and features of the invention will be set fourth in the detailed description as follows.

BRIEF DESCRIPTION OF THE DRAWINGS

The preferred embodiment of the present invention is described herein with reference to the drawing wherein.

DETAILED DESCRIPTION OF THE INVENTION

Figure 2:
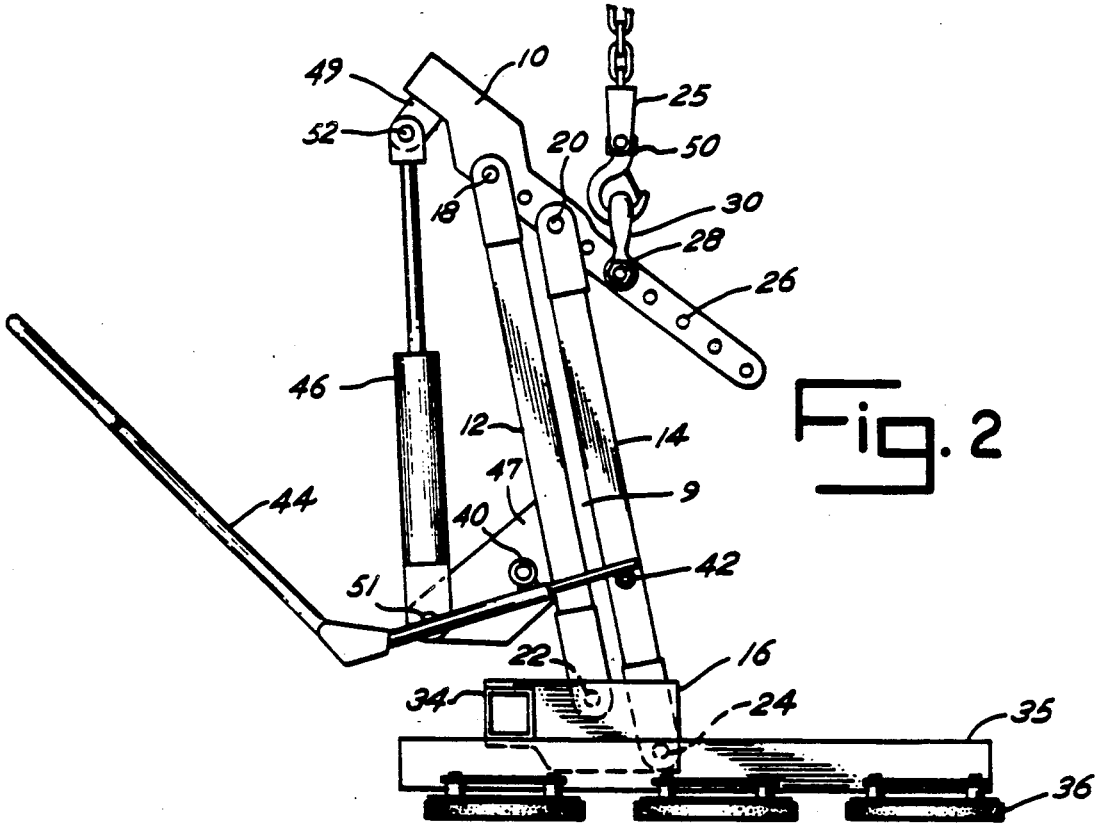
FIG. 2 is a side view of the preferred embodiment of the invention in which the object is in a horizontal orientation.

FIG. 2 illustrates a quadrilateral frame 9 with each frame member pivotally attached to the adjacent frame members. The frame 9 comprises a generally horizontal upper frame member 10 pivotally connected to a pair of generally vertical frame members 12, 14 which, in turn, are both pivotally connected to a generally horizontal lower frame member 16. The first vertical member 12 has a upper pivotal connection 18 pivotally attaching it to the upper member 10 and a lower pivotal connection 22 pivotally connecting it to the lower member 16. The second vertical member 14 has a upper pivotal connection 20 and a lower pivotal 24 connecting respectively to members 10 and 16.

In the preferred embodiment the vertical members 12, 14 are of equal length, the distances between the upper pivotal connections 18, 20 and between the lower pivotal connections 22, 24 are the same. Therefore the vertical members 12, 14 and the upper and lower members 10, 16 form a parallelogram. However, the length and the orientation of any of the frame members 10, 12, 14, 16, may be varied for particular applications to define a quadrilateral frame which is not a parallelogram. This type of variation will alter the shape of the frame 9 by changing the angle at which the members connect to each other, thus, altering the lifting and orienting characteristics of the mechanism.

The upper member 10 is adapted to allow the frame 9 to be pivotally suspended from a hanger 25. This may be done by putting a horizontal passage 26 in the upper member 10 for insertion of a bolt 28 to secure an eye 30 which in turn engages the hanger 25. This passage 26 may be defined either in an extension of the upper member 10 or it may be in the region of the upper member 10 which is between the upper pivotal connections 18, 20. The pivotal interaction between the bolt 28 and the passage 26 allows the frame 9 to pivot about a first generally horizontal axis of rotation 21, which is defined by a line passing through the passage 26 substantially perpendicular to the upper member 10.

The object to be oriented or tilted will pivot about a second pivot axis of rotation 23. The location of this second pivot axis 23 is determined by the location of the first axis of rotation 21. The second axis of rotation 23 will have the same relationship to the lower pivotal connections 22, 24 as the first axis of rotation 21 has with the upper pivotal connections 18, 20. Therefore, the upper member 10 is provided with multiple passages 26 so that the second axis of rotation 23 and thus the axis about which the object is pivoted or tilted can be varied. In the preferred embodiment the passage 26 is selected so the second axis of rotation 23 is located within the object to be lifted and oriented, and preferably is positioned so as to pass through the center of gravity of the object. This location provides maximum control of the object while requiring a minimum force to effect the lifting and orienting.

Thus, attached to the lower member 16 is means for supporting an object. In the preferred embodiment this means includes a bar 34 attached to the lower member 16 and an associated framework 35 supporting at least one vacuum cup 36. The mechanism is also effective when means other than a vacuum cup are provided to attach and support the object e.g. bolts or clamps. Thus, attachment means may vary with the nature of the object to be attached.

Figure 1:
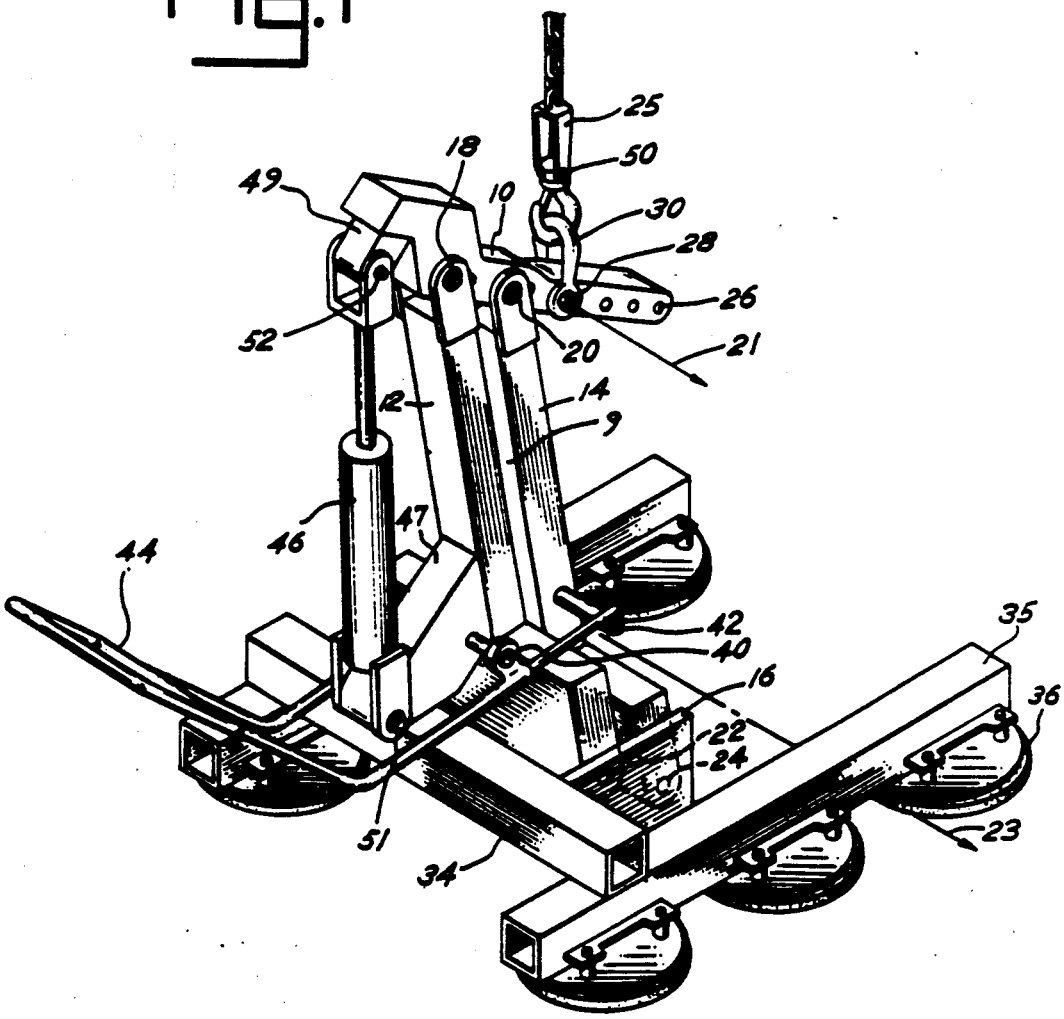
FIG. 1 is a perspective view of the preferred embodiment of the invention.

The orienting or tilting is accomplished by altering the angular relationship of the frame members 10, 12, 14, 16. This is accomplished by a handle 44 attached to the two vertical members 12, 14 at a pair of pivotal connections 40, 42. The first pivotal connection 40 is located on the vertical member 12 intermediate the pivotal connections 22, 18. The second pivotal connection 42 is located on the other vertical member 14 intermediate the pivotal connections 20, 24. FIG. 1 illustrates that the handle 44 may be U-shaped and formed so as to facilitate access to the handle 44. In such a structure the handle 44 engages the vertical members 14, 12 on two opposing sides. Therefore on the opposing side there are pivotal connections corresponding to the pivotal connections 40, 42.

The handle 44 allows for manual manipulation of the frame. When the handle 44 is pushed downward or forced upward the angular relationship of the adjacent frame members is altered. This change in angular relationship causes the upper member 10 to pivot about the first axis of the rotation 21 and the vertical members 12, 14 to move substantially vertically. This action causes movement of the lower member 16 which causes the object to be rotated about the second axis of rotation 23.

Figure 3:
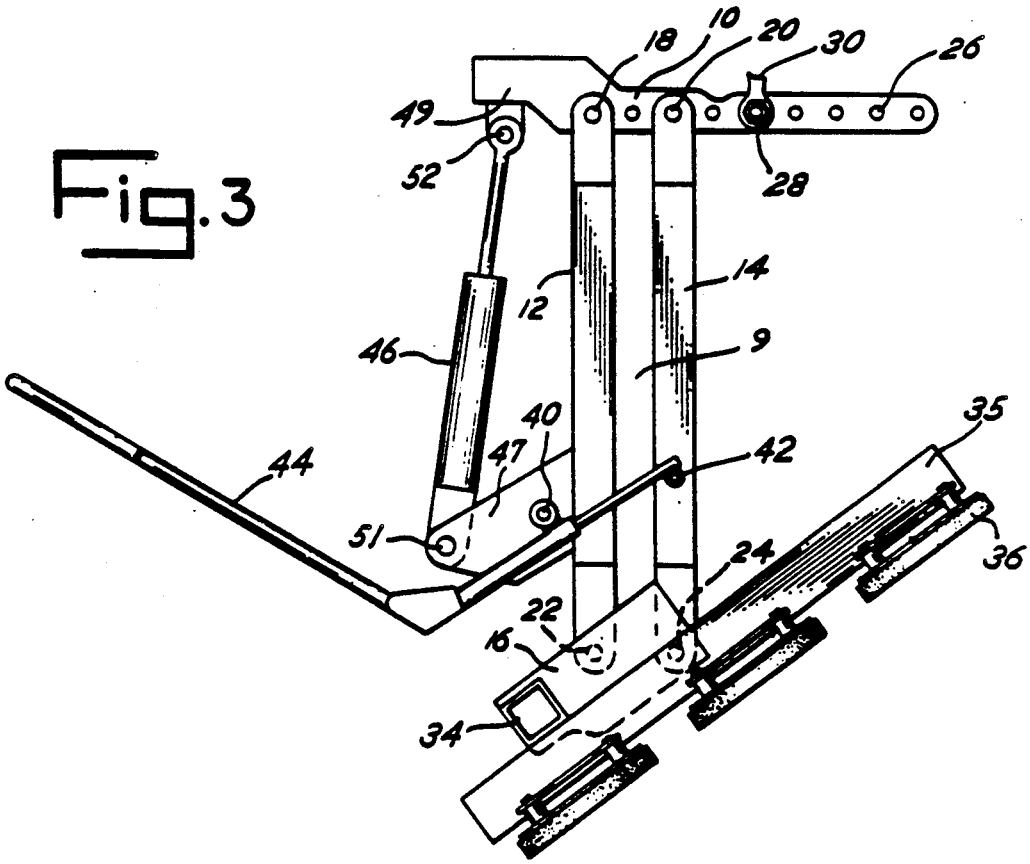
FIG. 3 is a side view of the preferred embodiment of the invention which shows the object tilted at about a 45 degree angle.
Figure 4:
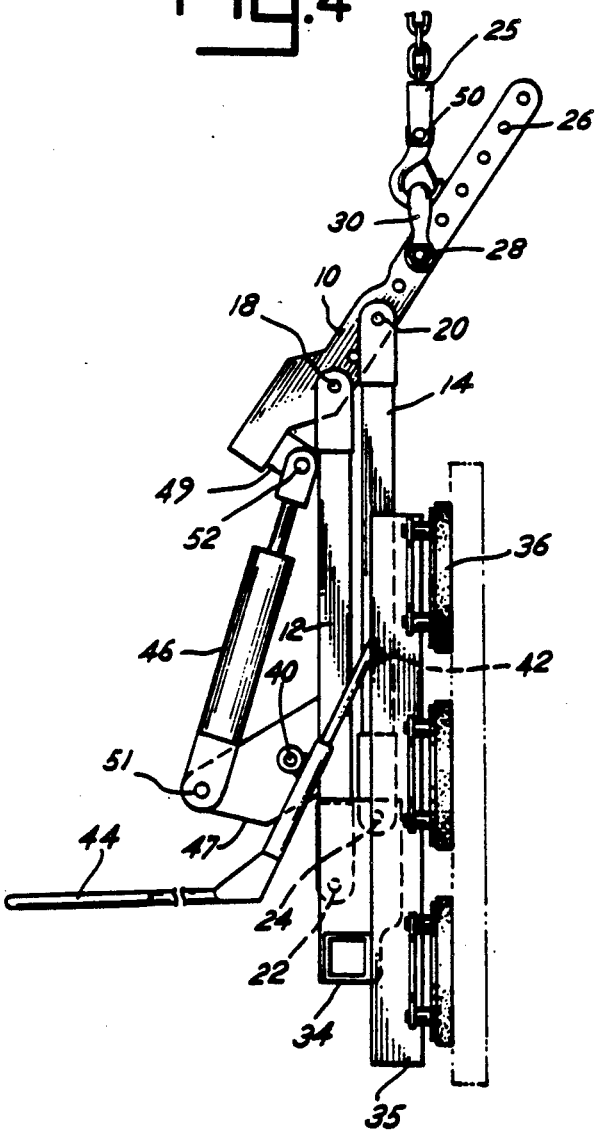
FIG. 4 is a side view of the preferred embodiment of the invention showing the object tilted so that it is in vertical orientation.

FIGS. 3 and 4 show how the handle 44 alters the frame 9 and allows for orienting or tilting of the object. The mechanism could be given power assist, such as a linear actuator, to achieve the same results.

The preferred embodiment also includes means for counterbalancing the weight of the frame 9. This means can include a hydraulic cylinder 46 which is pivotally attached to the upper member 10 and one vertical member 12 in such a way as to counter act the weight of the frame 9. FIG. 1 shows the hydraulic cylinder 46 as it is attached to the frame 9. This embodiment utilizes a lower bracket 47 extending outwardly from the vertical member 12 and a upper bracket 49 extending from the upper member 10 to provide a place for attachment of the cylinder 46 by way of pivotal connection 51 and 52 respectively. This structure provides room for cylinder 46 to operate. The cylinder 46 acts as a spring in compression to compensate for the weight of the frame 9 and reduce the force necessary for lifting and orienting the object.

Figure 5:
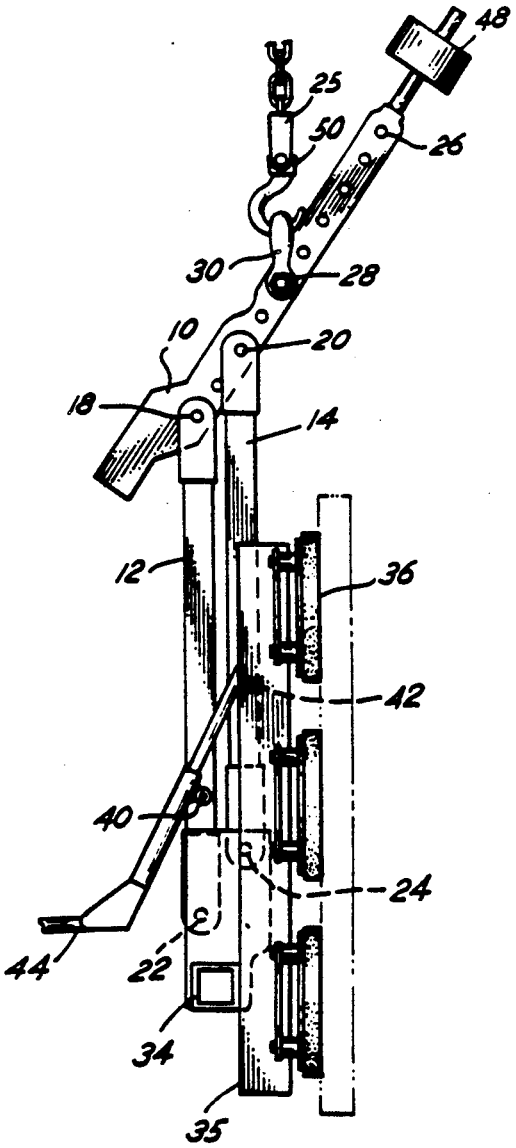
FIG. 5 is a modification of FIG. 4 showing how an hydraulic cylinder actuator or force compensation can be replaced by an adjustable counter weight.

Another possible counterbalance is an adjustable weight 48 mounted on the extension of the upper member as shown in FIG. 5. This counterbalance weight 48 also reduces the force necessary for lifting and orienting the object.

Yet another feature of the preferred embodiment, shown in FIG. 1, is a swivel 50 operatively associated with the hanger 25 allowing the rotation of frame 9. The swivel 50 permits the frame 9 to be rotated about a substantially vertical axis that is coincident with the hanger 25. This feature allows the object to be oriented or tilted through yet another dimension.

The above description is illustrative of the present invention and is not intended to limit the invention in spirit or scope. Only the following claims and their equivalents limit the scope of the invention.

What I claim is:

1. An improved mechanism for lifting and orienting an object comprising in combination:

(a) a quadrilateral frame including an upper generally horizontal frame member and a lower member and two generally vertical members pivotally connecting the upper and lower members whereby each frame member is pivotally connected to the adjacent two frame members, each frame member having a fixed length between pivot connections;

(b) external means for supporting said frame, said external means operatively and pivotally connected to the upper frame member, said means including means for pivoting the frame about a first generally horizontal axis of rotation;

(c) means for altering the angular relationship of the frame members and for pivoting an object about a second axis of rotation parallel to the first axis of rotation, said second axis of rotation having substantially the same spacial relationship to the pivotal connections between the lower frame member and the two generally vertical frame members as said first axis of rotation has with pivotal connections between the upper frame member and the two generally vertical frame members; and (d) means for supporting an object operatively associated with the lower frame member, said supporting means being capable of pivoting about said second axis of rotation upon the altering of the angular relationship of the frame members.

2. The mechanism of claim 1 where the opposing members of the quadrilateral frame are the same length.

3. The mechanism of claim 1 wherein means for supporting an object comprises a frame work supporting at least one vacuum cup.

4. The mechanism of claim 1 wherein the means for altering the angular relationship of the frame members comprises a handle operatively attached to opposing members of the frame.

5. The mechanism in claim 1 wherein the means for altering the angular relationship of the frame member comprises a linear actuator operatively attached to adjacent members of the frame.

6. The mechanism of claim 1 further comprising swivel means operatively associated with the external support means allowing the frame to be pivoted about a substantially vertical axis coincident with said support means.

7. The mechanism of claim 1 further comprising means to counter balance the weight of the frame.

8. The mechanism of claim 7 wherein the means to counterbalance the frame is an adjustable weight operatively attached to same frame member as the supporting means.

9. The mechanism of claim 7 wherein the means to counterbalance the frame is a hydraulic cylinder operative attached to adjacent frame members.

10. An improved mechanism for lifting and orienting an object comprising in combination:

(a) a quadrilateral frame including an upper and a lower member and two generally vertical members pivotally connecting the upper and lower members whereby, each frame member is pivotally connected to the adjacent frame members, each frame member having a fixed length between pivot connections;

(b) external means for supporting said frame, said external means operatively and pivotally connected to the upper frame member, said means including means for pivoting the frame about a first generally horizontal axis of rotation;

(c) means for altering the angular relationship of the frame members and for pivoting an object about a second axis of rotation passing through the object and parallel to the first axis of rotation, said second axis of rotation having substantially the same spacial relationship to the pivotal connections between the lower frame member and the two generally vertical frame members as said first axis of rotation has with pivotal connections between the upper frame member and the two generally vertical frame members; and (d) means for supporting an object operatively associated with the lower frame member, said supporting means being capable of pivoting about said second axis of rotation upon the altering of the angular relationship of the frame members.

11. The mechanism of claim 10 wherein the opposing members of the quadrilateral frame are the same length.

12. The mechanism of claim 10 wherein means for supporting an object comprises a frame work supporting at least one vacuum cup.

13. The mechanism of claim 10 wherein the means for altering the angular relationship of the frame members comprises a handle operatively attached to opposing members of the frame.

14. The mechanism in claim 10 wherein the means for altering the angular relationship of the frame member comprises a linear actuator operatively attached to adjacent members of the frame.

15. The mechanism of claim 10 further comprising swivel means operatively associated with the external support means allowing the frame to be pivoted about a substantially vertical axis coincident with said support means.

16. The mechanism of claim 10 further comprising means to counter balance the weight of the frame.

17. The mechanism of claim 16 wherein the means to counterbalance the frame is an adjustable weight operatively attached to same frame member as the supporting means.

18. The mechanism of claim 16 wherein the means to counterbalance the frame is a hydraulic cylinder operative attached to adjacent frame members.

19. An improved mechanism for lifting and orienting an object comprising in combination:

(a) a quadrilateral frame including an upper and a lower member and two generally vertical members pivotally connected to the upper and lower members whereby, each frame member pivotally connected to the adjacent frame members, each frame member having a fixed length between pivot connections;

(b) external means for supporting said frame, said external means operatively and pivotally connected to the upper frame member, said means including means for pivoting the frame about a first generally horizontal axis of rotation;

(c) means for altering the angular relationship of the frame members and for pivoting an object about a second axis of rotation, said second axis passing substantially through the center of gravity of the object and parallel to the first axis of rotation, said second axis of rotation having substantially the same spacial relationship to the pivotal connections between the lower frame member and the two generally vertical frame members as said first axis of rotation has with pivotal connections between the upper frame member and the two generally vertical frame members; and (d) means for supporting an object operatively associated with the lower frame member, said supporting means being capable of pivoting about said second axis of rotation upon the altering of the angular relationship of the frame members.

20. The mechanism of claim 19 where the opposing members of the quadrilateral frame are the same length.

21. The mechanism of claim 19 wherein means for supporting an object comprises a frame work supporting at least one vacuum cup.

22. The mechanism of claim 19 wherein the means for altering the angular relationship of the frame members comprises a handle operatively attached to opposing members of the frame.

23. The mechanism in claim 19 wherein the means for altering the angular relationship of the frame member comprises a linear actuator operatively attached to adjacent members of the frame.

24. The mechanism of claim 19 further comprising swivel means operatively associated with the external support means allowing the frame to be pivoted about a substantially vertical axis coincident with said support means.

25. The mechanism of claim 19 further comprising means to counterbalance the weight of the frame.

26. The mechanism of claim 25 wherein the means to counterbalance the frame is an adjustable weight operatively attached to same frame member as the supporting means.

27. The mechanism of claim 25 wherein the means to counterbalance the frame is a hydraulic cylinder operative attached to adjacent frame members.

* * * * *